United States Patent [19]

Oliver et al.

[11] 4,250,428

[45] Feb. 10, 1981

[54] BONDED CATHODE AND ELECTRODE STRUCTURE WITH LAYERED INSULATION, AND METHOD OF MANUFACTURE

[75] Inventors: David W. Oliver, Schenectady; Casmir R. Trzaskos, Amsterdam, both of N.Y.

[73] Assignee: The United States of America as represented by the Secretary of the Army, Washington, D.C.

[21] Appl. No.: 37,257

[22] Filed: May 9, 1979

[51] Int. Cl.[3] ..... H01J 1/88; H01J 19/42

[52] U.S. Cl. ..... 313/268; 313/348; 313/107; 313/250; 29/25.1; 29/25.16

[58] Field of Search ..... 313/348, 268, 107, 346, 313/250, 302, 304, 309; 29/25.1, 25.11, 25.16

[56] References Cited

U.S. PATENT DOCUMENTS

| | | | |
|---|---|---|---|
| 3,373,307 | 3/1968 | Zalm et al. | 313/346 R |
| 3,402,314 | 9/1968 | Vlaardingerbroek et al. | 313/348 |
| 3,599,031 | 8/1971 | Beggs | 313/268 |
| 3,648,096 | 3/1972 | Beggs | 313/348 |
| 3,967,150 | 6/1976 | Lien et al. | 313/348 |
| 4,083,811 | 4/1978 | Bachmann et al. | 313/346 R |
| 4,096,406 | 6/1978 | Miram et al. | 313/348 |
| 4,165,473 | 8/1979 | Falce | 313/346 R |

*Primary Examiner*—Saxfield Chatmon, Jr.
*Attorney, Agent, or Firm*—Nathan Edelberg; Jeremiah G. Murray; Bernard Franz

[57] ABSTRACT

The variety of technologies that have been applied in the development of a bonded grid cathode are described. These include chemical vapor deposition of tungsten, molybdenum, iridium, BM, and $Si_3N_4$ on both sides of a sintered tungsten cathode disk. Zirconium and titanium getters have been used to eliminate nitrogen evolution problems. Films of $Si_3N_4$ have been added to the insulation to prevent calcium and barium diffusion into the layer and maintain adequate resistivity and breakdown strength. Plasma etching was introduced as a method of removing $Si_3N_4$ from the cathode pores.

19 Claims, 7 Drawing Figures

BONDED CATHODE AND ELECTRODE STRUCTURE WITH LAYERED INSULATION, AND METHOD OF MANUFACTURE

The invention described herein may be manufactured and used by or for the Government of governmental purposes without the payment of any royalties thereon or therefore.

BACKGROUND OF THE INVENTION

This invention relates to a bonded cathode and electrode structure for microwave triode tubes, a method of manufacture, and more particularly to a structure and method using boron nitride insulation bonded between a cathode and a control grid.

The grid-controlled power amplifier has long been useful for a variety of microwave applications. The L-64 and L-67 types, developed by J. E. Beggs and his associates as a consequence of work sponsored by the U.S. Army Electronics Command, have extended the range of performance of such devices. These advances were attained through the use of a closely spaced grid-cathode structure operating in the high-vacuum environment of a titanium-ceramic tube structure.

The construction of grid-cathode units with even closer spacing of grid and cathode and capable of high grid dissipation was continued using a grid and a heater which are rigidly bonded to the cathode by an insulating film. Boron nitride (BN) was identified as the preferred insulating material. Chemical vapor deposition (CVD) of BN was developed, and grid patterns with detail as small as 0.002 inch were formed by erosion through a mask with air driven $Al_2O_3$ particles. The d-c characteristics of bonded grid tubes showed a high utilization of emission as useful plate current, ability to withstand large positive grid bias, and the option of a high level of current collection or a wide grid-anode gap. See U.S. Pat. Nos. 3,599,031; 3,638,062; and 3,694,260 by J. E. Beggs.

Several significant technical problems remained, potentially blocking the successful development of still further improvements at higher microwave frequencies of a bonded grid triode. These were:

A continuous buildup of nitrogen gas within the tube when bonded grid-cathode structures were operated at 1050 degrees C. Tube characteristics were degraded in less than an hour of continuous operation.

Degradation of the grid-cathode and heater-cathode resistances by a factor of 1000 in about thirty hours of operation.

Lack of a process for forming grid openings with dimensions as small as 0.001 inch without either undercutting the supporting insulation or shorting out the insulating layer with metal.

A method of removing photo resist in a partial pressure of a gas, which may be hydrogen, at about 100 degrees C. is shown in U.S. Pat. No. 3,837,856. Other U. S. patents on removing resist are U.S. Pat. Nos. 3,787,239; 3,582,401; 3,458,312; and 3,676,219.

SUMMARY OF THE INVENTION

An object of the invention is to improve the longterm resistance stability of the insulating layer between the cathode and the grid (and also the heater) in a bonded grid-cathode tube.

Features of the invention relate to the structure and manufacture method in which diffusion barriers of silicon nitride are incorporated in the insulating layer. In particular, with a principal insulator of boron nitride, thin films of silicon nitride are used between it and the cathode, and also between it and the grid. As a further detail feature, an additional thin film of BN is used for stress relief next to the cathode.

Additional objects and features appear in the following detailed description.

CROSS REFERENCE TO RELATED APPLICATIONS

This application partially discloses matter claimed in related applications to be filed on the same day in the same package. The others are incorporated herein and made a part hereof as though fully set forth.

The combination getter and internal structure with heat shield is covered in an application by D. W. Oliver and N. T. Lavoo, Ser. No. 037,256.

The method of erosion lithography and a high aspect ratio nozzle for obtaining uniform erosion to form the openings for fine grid detail are covered in an application by D. W. Oliver, Ser. No. 037,258, and its divisional applications Ser. No. 149,204 and Ser. No. 149,205

DETAILED DESCRIPTION

Figure 1:
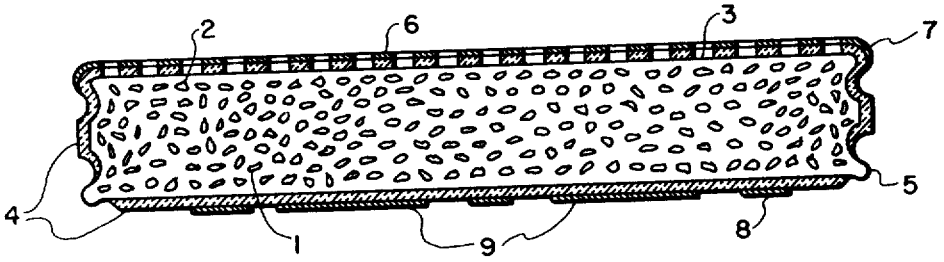
FIG. 1 (Prior Art)
FIG. 1 illustrates a prior art bonded grid-cathode-heater unit for a microwave vacuum tube.

FIG. 1 shows a cross section of a prior art bonded heater-cathode-grid structure for use in the microwave power-amplifier tube disclosed in U.S. Pat. No. 3,638,062 by J. E. Beggs. It embodies a cathode disk (twin-grooved around its edge, boron nitrode (BN) insulation, and tungsten (W) film grid and heater electrodes. This control unit can be efficiently heated, can withstand large voltages between grid and cathode, and has a high grid dissipation capacity. It is operated in the tube near 1050 degrees C.

The cathode disk used in this assembly can be an impregnated type such as a Philips Type B or a Semicon Type S. The impregnant is removed from the outer surfaces prior to the BN deposition so as to prevent a direct reaction with the chemical vapors. This cleaning procedure also permits the BN insulation to become mechanically locked in the open pores of the tungsten surface.

Chemical vapor deposition processes are used to deposit BN and W layers onto the cathode. The completed structure is made by opening holes in the tungsten and BN layers. Other forms of the tube and of the bonded heater-cathode-grid structure are shown in U.S. Pat. Nos. 3,599,031 and 3,694,260 by J. E. Beggs. These patents show the structure and the method of manufacture, and include a discussion of alternate materials which may be used. The three Beggs patents are incorporated herein and made a part hereof by reference.

In FIG. 1, the tungsten cathode 1 has open pores 2, an emission impregnant and an emission surface 3. An insulating layer 4 of BN is formed on all sides by chemical vapor deposition. The portion of the insulating layer in and adjacent the lower groove is removed to provide a cathode contact region 5. A tungsten film is formed over the insulating layer, and perforations are formed by providing a mask and using a blast gun to erode through the insulating layer to form a control grid 6. The tungsten film extends to the upper groove to provide a grid contact region 7. A heater 8 is formed in the tungsten film on the opposite face, with heater contact regions 9. Grid patterns with detail as small as 0.002 inch have been formed by erosion through a mask with air driven by $Al_2O_3$ particles. U.S. Pat. No. 3,694,260 also discloses forming a photo resist layer over the tungsten film, developing a grid pattern therein, forming the grid holes in the tungsten film by etching, and using the photoresist and tungsten film as a composite mask for air blast erosion of the holes in the BN insulator.

Further development of the tube structure, and method of manufacturing it have continued, to obtain a tube whose characteristics are: a peak power output of one kilowatt at a duty factor of 0.1, a 1 db bandwidth of 400 megahertz at 3,300 megahertz, a power gain of 15 db, and an overall efficiency of 30%. Calculation shows that these characteristics require as tube parameters: grid-cathode capacitance equal or less than 175 picofarads, grid transparency of 75%, insulator dielectric constant of approximately 4; cathode area equal or less than 2.6 square centimeters, cathode emission density equal or greater than 1.4 ampere per square centimeter average or 6.4 ampere per square centimeter peak.

The most important parameters for selecting the insulating film are the film dielectric constant, resistivity, and stability at the cathode operating temperature. The preferred material selected is BN. This material also has a good expansion match to tungsten, and has the unique property among high resistivity refractories of being soft and, hence, not subject to cracking due to expansion differentials. Problems with BN were (1) a continuous buildup of nitrogen gas within the tube when bonded grid-cathode structures are operated at 1050 degrees C., and (2) degradation of the grid-cathode and heater-cathode resistances during operation.

NITROGEN GAS IN BONDED HEATER-CATHODE GRID TUBES

Some evaporation will occur with any material used in a tube with cold walls, and gas pressure can be expected to build up continuously (the equilibrium vapor pressure is not a limit) unless there is a getter present to remove the evolved gas. As evaporation proceeds, one can expect the surface or the bulk composition of the refractory to change. The electrical characteristics of the film are expected to change with the composition and an optimum gas pressure is likely to exist within the enclosure for highest electrical resistivity. It is possible in principle to approximate this optimum pressure by properly adjusting the gettering rate.

An ideal material for a high temperature insulator in a vacuum tube is one which evaporates congruently in molecular form without dissociation. However, most of the refractory high temperature insulators, oxides and nitrides, dissociate upon evaporation. For BN the dissociation products are B and $N_2$. Equilibrium between gas and solid occurs when the solid is heated in a closed container which has walls unreactive to the solid or its evaporation products. Under these conditions, the gas pressure increases until there is a balance between collisions of gas atoms on the surface and the evaporative flux of atoms away from the surface.

However, when a refractory is heated in an evacuated chamber with cold walls, as in a vaccum tube, the conditions are different from the thermal equilibrium situation. In fact, if a refractory which dissociates is allowed to evaporate in an enclosure with cold walls the internal pressure can be expected to increase well beyond the equilibrium vapor pressure. Consider BN. There will be a rate of evaporation of nitrogen which is greater than the rate of evaporation of boron. For every atom of boron which reaches the cold wall and is unable to recombine with nitrogen because of low reaction rate at the wall temperature there will be a nitrogen atom left in the enclosure and the gas pressure will rise continuously as the BN evaporates. Not only will the gas pressure rise but the BN will change its composition, since N is leaving faster than B. If the refractory is thick and nitrogen diffusion is slow, a boron-rich layer will build up on the surface until the evaporation rate for nitrogen is limited by diffusion to the values of the evaporation rate of boron. If the sample is thin and diffusion is rapid, then the average composition of the sample must alter, until the evaporation rates for boron and nitrogen balance.

Because the use of BN results in the liberation of nitrogen during operation, a getter is incorporated in the bonded grid tubes. Both zirconium and titanium will pump nitrogen, have a high solubility for nitrogen, do not release it when reheated, and are sufficiently refractory for tube assembly.

Titanium and zirconium getters have been assembled into tubes in the form of a pair of heat shields spaced close behind the cathode. Radiation from the cathode heats the getter plate to a temperature of about 840 degrees C. The heated getter plates not only pump nitrogen but also act as heat shields and reduce the heater power required to maintain cathode temperature. Tubes operated with titanium getters have showed no gassing problems. Zirconium getter plates are found to be superior to titanium, but commercial grade zirconium is not satisfactory because of impurities such as iron and the fact that it evolves hydrogen. Zirconium made by the iodide process and zone-refined zirconium have been found satisfactory as getter-heat shields in assembled tubes.

NON-STOICHIOMETRIC BN, AN EXCELLENT ELECTRICAL INSULATOR

In many modern devices it is necessary to use a thin film insulator covering a large area and having low leakage resistance. One of the applicable materials is hexagonal BN, and it has a resistivity at high temperatures which exceeds that of other available materials. However, BN is subject to evaporation at high temperature. One product resulting from this project is hexagonal BN prepared in a non-stoichiometric form with a reduced nitrogen content and having the properties of a reduced evaporation rate (rate of loss of nitrogen) and increased electrical resistivity as compared with BN prepared by state of the art chemical vapor deposition or ceramic technology. Such a non-stoichiometric BN insulator operating, for example, at 1000 degrees C. has a dissociation rate ten times smaller and a resistivity 4× larger than that of stoichiometric BN. This invention has been reduced to practice by subjecting chemically vapor deposited BN to a high temperature vacuum anneal. (30 minutes at 1590 degrees C. for an insulator 1 mil thick, is one example of a range of conditions which have been used). The non-stoichiometric films may be achieved by direct deposition of the appropriate composition as well as by vacuum annealing after deposition.

RESISTANCE OF BORON NITRIDE LAYERS

Layers of hexagonal BN serve as excellent electrical insulation. At high temperatures, near 1000 degrees C., its resistivity near $10^9$ ohm-cm surpasses that of alternative materials. However, its resistivity particularly at high temperature can be markedly reduced, by factors of one thousand times, as a result of impurity diffusion into the BN layer, when used adjacent to a source of cathode impregnant—BaO, CaO, or $Al_2O_3$. In a few tens of hours the resistivity decreases to a value near $10^6$ ohm-cm, and then remains relatively stable. The resistance values observed are lower than desirable but are considerably larger than the rf impedance levels of a functioning tube. Other effects (a low value of breakdown strength, hysteresis in current-voltage characteristics, and nitrogen production by electrolysis) make layers degraded by CaO and BaO unacceptable for use in vacuum tubes.

The problems associated with barium and calcium migration were solved by using composite films, including silicon nitride. The insulating layer is made of a mixture of BN and silicon nitride to compensate for electrically active impurities, or of adjacent layers of $Si_3N_4$ and BN. In the latter case, diffusion of Si in BN or incorporation of Si into the BN during fabrication provides compensation. The separate $Si_3N_4$ layers act in addition as diffusion barriers. In the presence of a high electric field the $Si_3N_4$ layers have an additional function—they block electrode reactions and their lower resistivity than BN causes the electric field across the $Si_3N_4$ to be low, reducing field assisted diffusion processes.

Silicon nitride was chosen as the most promising material for a diffusion barrier/compensation film. The objective was retention of the excellent electrical, thermal, and mechanical properties of intrinsic BN and elimination of the rapid electrical resistance degradation experienced with BN in contact with impregnant at cathode operating temperature. The choice of $Si_3N_4$ was based upon several factors.

Diffusion Barrier. In the semiconductor industry, $Si_3N_4$ has proven to be a unique material for diffusion barriers in high-temperature processing applications.

Compensation. Tetravalent silicon in BN has the appropriate valence to compensate for divalent barium or calcium.

Low Voltage Across Barrier. At cathode operating temperatures the electrical resistance of $Si_3N_4$ is orders of magnitude lower than that of BN. In an insulating composite, or "sandwich," of $Si_3N_4$/BN/$Si_3N_4$ the electrical voltage will be predominantly across the high-resistivity BN layer. Hence, in biased high-temperature operation the electric fields in the $Si_3N_4$ layers will be too small to cause significant ion transport through the layer. Because $Si_3N_4$ is a hard and brittle refractory it is desirable to keep the layers thin if they are not to crack during thermal cycling because of thermal expansion mismatches. A thin $Si_3N_4$ layer is also consistent with a composite that is predominantly BN, for high total resistivity and ease of manufacturing a fine grid structure.

The addition of a $Si_3N_4$ source to the BN deposition apparatus was the only equipment modification required to implement composite layers. The chemical vapor deposition of $Si_3N_4$ was achieved by reacting silane with ammonia at a substrate temperature of 1075 to 1100 degrees C.

$$3SiH_4+4NH_3 \rightarrow Si_3N_4+12H_2$$

This approach minimizes the possibility of contamination, since only one new element, silicon, is introduced into the deposition apparatus. The byproduct of the reaction, hydrogen, is easily pumped away. Composite layers of insulation were made by successively depositing onto an impregnated cathode ½ μm of $Si_3N_4$, 12 to 15 μm of BN, ½ μm of $Si_3N_4$, and 2 to 5 μm of tungsten or molybdenum.

Figure 2:
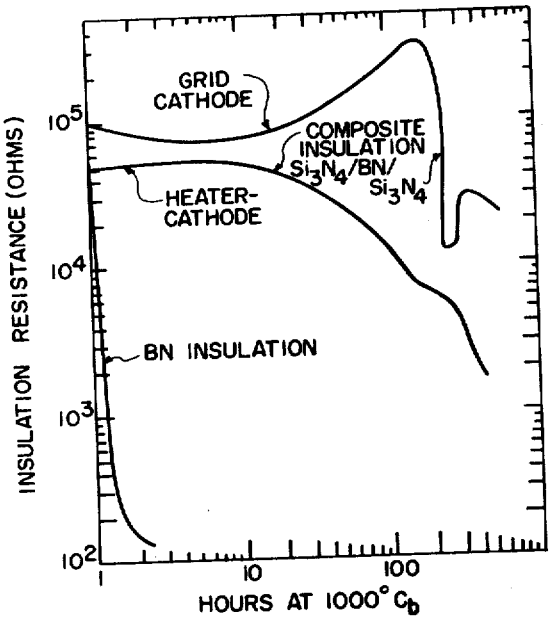
FIG. 2 is a graph showing improvement of resistance stability with diffusion barriers.

Improvement in resistance versus time for the composite insulation was startling. The composite insulation effectively solved the problem of resistance degradation and, in addition, improved film adherence. FIG. 2 shows the results of resistance versus time for insulation layers of BN and composite layers of $Si_3N_4$/BN/$Si_3N_4$ on an impregnated cathode operated at 1050 degrees C.

The addition of $Si_3N_4$ films introduced an additional problem, however. A cathode covered with ½ μm of $Si_3N_4$ and nothing else could produce only a few microamperes of emission current at a temperature where amperes of current were collected prior to $Si_3N_4$ deposition. The complete cutoff of emission with such a thin layer was in marked contrast to effects observed with thin layers of other materials. Chemical vapor deposition of as much as several microns of metals such as molybdenum and tungsten caused slight emission increases. It became clear that the solution to resistance degradation would be useful only if a means could be found to clean $Si_3N_4$ out of the pores of the cathode after the grid structure was formed. It would be necessary to find a method of inexpensively fabricating grids with very fine detail, and to remove the $Si_3N_4$ from the bottom of the grid openings by a method which would maintain the integrity of the structure.

Borrowing once more from semiconductor technology, freon plasma etching was tried. This is a standard technique in the industry for removing $Si_3N_4$ by placing the sample in a low-pressure rf discharge of $CF_4$. The method was found to work. Silicon nitride could be removed from the cathode pores and much of the original emission capability restored. The details of emission restoration are complex and continue to be investigated. What occurs depends upon the nature of the original surface, whether it is a plain tungsten cathode or an iridium coated cathode. Emission restoration is also dependent upon the processing steps adopted to fabricate the fine grid structure.

Work continued on film deposition and emission improvement in conjunction with tube construction, but emphasis was shifted over to the fabrication of grids with appropriately fine grid detail. As an alternative to freon etching, experiments were performed on high-temperature etching of $Si_3N_4$ with hydrogen-water vapor. It was thought that under appropriate conditions volatile $B_2O_2$ and SiO might be driven from films. Etching with $H_2/H_2O$ was found to be possible; however, the required temperatures (near 1300 degrees C.) were excessive, the rate of BN etching was substantially higher than that of $Si_3Ni_4$, and appreciable quantities of stable oxides were formed on the surface under some conditions. The approach was therefore abandoned.

CHEMICAL VAPOR DEPOSITION

Low-Pressure Chemical Vapor Deposition of Boron Nitride

Figure 3:
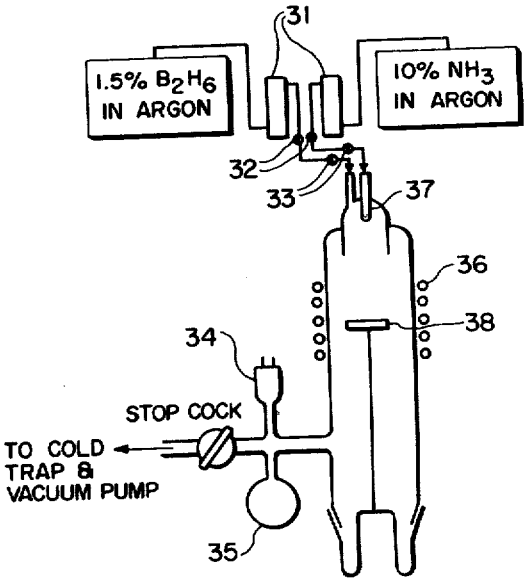
FIG. 3 is a diagram showing schematically the system for chemical vapor deposition of boron nitride.

The CVD system had been converted to low-pressure operation. The system evolved as depicted in FIG. 3 for chemical vapor deposition of boron nitride has two Matheson flowmeters 31, #622 PSV type #601, respectively, from the source of 1.5% $B_2H_6$ in argon, and the source of 10% $NH_3$ in argon, each followed by a Nupro valve 32, #SS-4H, and then a Nupro valve 33, #SS-4BMG. For the ammonia, the last valve 33 is followed by an injector 37 terminated with a series of holes around the perimeter at its tip. The heating is done with an induction coil 36, which is a Lepal Model T-25-I-KC-J-BW induction heater. The system exit for the gas is through a stop cock to a cold trap and vacuum pump. There is a G. E. vacuum gage 34, and a Wallace and Tiernan absolute pressure manometer 35.

Processing of the substrate 38 prior to BN deposition included sandblasting with 400-grit alumina and then cleaning ultrasonically in ethyl alcohol. In a typical BN deposition, the system was then evacuated to a pressure of $1\times10^{-4}$ torr. The substrate was heated in vacuum at 1050 degrees C. and then in 10 percent $NH_3$: argon flow rate of 45 $cm^3$/min. With the substrate at 1100 degrees $C_b$, the $NH_3$ flow rate is adjusted to the desired value; typically 45 $cm^3$/min. The system pressure is adjusted to ½ the final operating pressure. $B_2H_6$: argon is introduced at 25 $cm^3$/min and BN deposition takes place at a relatively low rate. Deposition is continued under these conditions for 10 minutes with the substrate temperature maintained at 1100 degrees C. After 10 minutes the $B_2H_6$ flow rate is increased in steps of 5 $cm^3$/min at 2-minute intervals until the desired flow rate is reached; usually 45 $cm^3$/min. Final adjustment is made to the system pressure, typically set at 1 to 2 cm, and the deposition is continued for the length of time required to obtain the desired thickness of BN. The deposition rate at a system pressure of 2 cm is 0.8 mils/hr for the parameters just described.

A qualitative measure was made of the deposition rate dependence on the various deposition parameters. The total system pressure had a fairly strong influence on the rate of deposition, with a high system pressure (2 cm) giving a deposition rate several times lower than that attained at a few mm. The deposition rate was seen to increase at temperatures up to 1300 degrees C. Above this temperature the rate was seen to decrease, becoming zero in some instances at 1600 degrees C.

The influence of the nitrogen-to-boron ratio on the depositing rate was also examined. The deposition rate was higher than N:B of 3 as compared to N:B of 5 to 10. Most depositions have been made with a N:B ratio of 3.3. Depositions made with a N:B ratio less than 3 tended to give tan-colored films, perhaps due to free boron.

Chemical Vapor Deposition of Tungsten

Frequently, during BN deposition, the chamber becomes coated with unreacted intermediates. These films can slowly evolve gas and are a possible source of contamination to any further processing. For this reason the BN coated substrate is remounted in a piece of apparatus in which the tungsten deposition is carried out.

The substrate is first fired in vacuum at 1050 degrees C. to remove any contaminants it may have collected during its transfer. It is next fired at 1100 degrees C. in pure $NH_3$ at a few millimeters pressure, to convert any surface oxide back to the nitride.

Ammonia is also used during the tungsten deposition as an aid in suppressing carbon formation and to prevent oxidation. The initial tungsten layer is deposited at a substrate temperature of 975 degrees C., an $NH_3$ pressure of approximately 8 $\mu$m, and approximately 2.3 $\mu$m $W(CO)_6$. As the tungsten film develops, one typically observes a decrease in substrate temperature of approximately 25 degrees C. followed by a fairly rapid increase as the growing tungsten layer begins to modify the emissivity of the surface being coated. The temperature is allowed to rise to 1000 degrees C. and is then maintained at that point. After 10 to 15 minutes, no further change in emissivity is observed. The surface now has an opaque tungsten film. At this point the $NH_3$ pressure is increased to 15 $\mu$m, the $W(CO)_6$ to 10 $\mu$m, and the coating process is continued for 90 minutes. This results in a tungsten film approximately 0.3 mil thick and gives a room temperature heater resistance of 0.4 to 0.5 ohms.

Molybdenum has been deposited at times in place of tungsten. The carbonyl is used and the procedures are very similar to those used with tungsten.

Chemical Vapor Deposition of Iridium

To increase cathode emission, iridium is deposited on the cathode after mechanical preparation and before the insulation is applied. Deposits were made by evaporation from an electron-beam-heated source and by chemical deposition from iridium carbonyl. The latter procedure has been used primarily because of its compatibility with the apparatus in use for other deposits and because somewhat better emission was obtained with CVD layers.

The apparatus and conditions for iridium deposition are somewhat different than for the other carbonyl processes. Control of the temperature of the jacket of the apparatus is important to the prevention of carbonyl deposition. The substrate needs to be raised to only a few hundred degrees centigrade to obtain a deposit.

Uniform Coating of Two Sides of a Cathode

Figure 4:
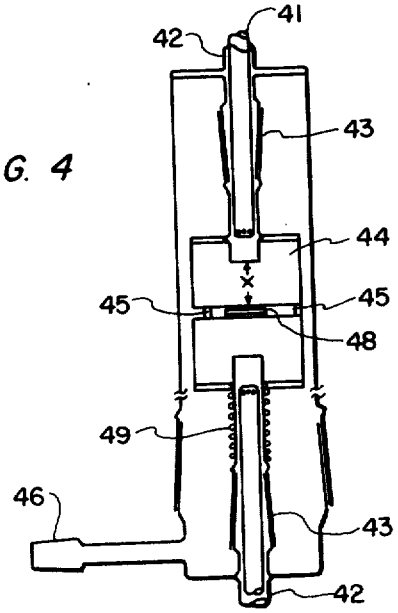
FIG. 4 is a diagram showing a modified system for radially uniform CVD on two sides of a disk.

The apparatus depicted in FIG. 3 has the drawback of producing different film thicknesses at front and back and of providing little control of radial variations of film thickness. An apparatus was constructed to solve these problems by admitting the reactive gases axially and exhausting them radially. The system is shown schematically in FIG. 4. Reactive gases are admitted coaxially by means of the tubing at points 41 and 42.

Since the system is symmetric about the cathode, the two dies are coated to equal thicknesses. The taper joints 43 enable one to adjust the separation (X) from the inlets to the cathode surfaces. Because the cathode is heated by rf induction, its outer edge is slightly hotter than its center and deposits tend to be thicker at the periphery than at the center of the cathode. By control of gas entrance velocity and the separation X, gas flow and diffusion processes can be used to compensate to first order for the effect of the radial temperature distribution on film thickness. Bringing the gas in close to the center of the cathode tends to make the film thicker there. By adjusting X the films can be made uniform in thickness to within about 10 percent.

The slotted inner chamber 44 forces the gas to exit radially from the vicinity of the cathode. The cathode 48 is supported by a wire spider (not shown), which engages three small radial holes on the periphery of the cathode, and which rests on the slot cut around the midline of the inner chamber. Small struts 45 hold the halves of the inner chamber together. There is a support spring 49, and an outlet port 46.

SUMMARY OF RESULTS AND CONCLUSIONS

A variety of technologies have been applied to the development of a bonded grid cathode as described. These include chemical vapor deposition of tungsten, molybdenum, iridium, BN, and $Si_3N_4$ in uniform deposits on both sides of a cathode. Zirconium and titanium getters were introduced to eliminate nitrogen evolution problems. Films of $Si_3N_4$ were added to the insulation to prevent calcium and barium diffusion into the layer and maintain adequate film resistivity and breakdown strength. Plasma etching was introduced as a method of removing $Si_3N_4$ from the cathode pores.

Figure 5:
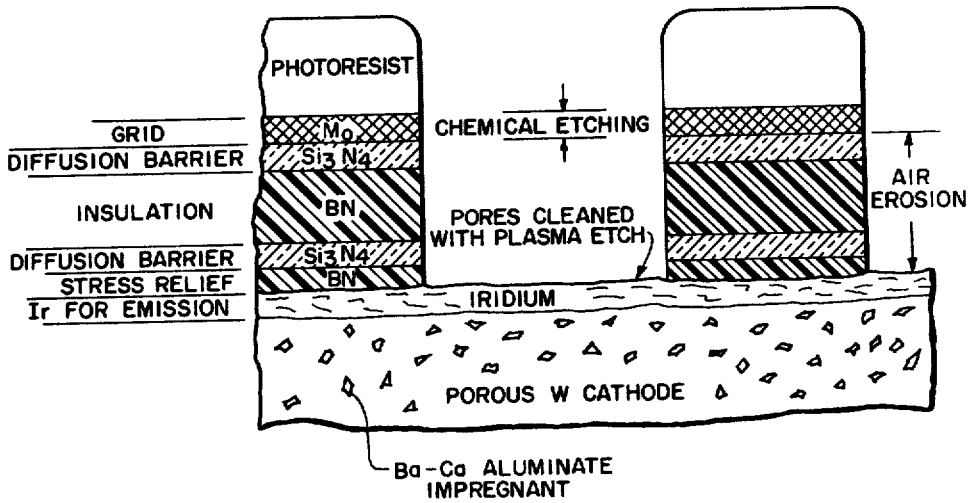
FIG. 5 is a diagram of a section of a bonded-grid cathode structure, indicating steps of formation and the functions.

A new method, erosion lithography, was invented for making a fine-detail grid structure economically by combining air erosion, using rectangular nozzles, with lighographic methods. These developments provide the "tool kit" for building bonded grid tubes, as shown schematically in FIG. 5.

FABRICATION PROCEDURE FOR THE BONDED-GRID TRIODE AMPLIFIER

The bonded-grid triode amplifier is fabricated in several parallel assembly steps.

Figure 6:
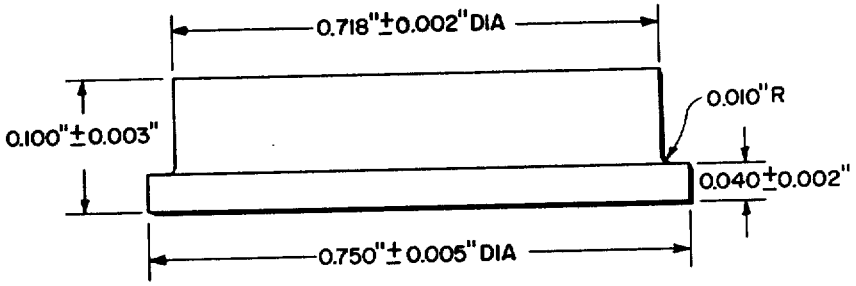
FIG. 6 shows a cathode blank as received from the manufacturer.

The cathode blanks are manufactured by Semicon Associates, Inc., a subsidiary of Varian Associates. The first step in the cathode preparation is to polish the blanks because, as received from the manufacturer (see FIG. 6) the blanks have a lathe-cut surface. It is necessary to dry-polish in two stages; first with a coarse-grit polishing wheel and then with a fine polishing wheel, to remove machining marks and 2 to 3 mils of the original surface. The blanks are then sandblasted with alumina powder to provide a rough surface for better adhesion of the insulator layers. Residual traces of aluminum oxide are removed by cleaning the blanks ultrasonically in ethyl alcohol. The blanks are then hydrogen-fired at 1325 degrees C. (brightness temperature) for 10 minutes to remove contaminants which may have been introduced in the polishing operation. They are then activated in high vacuum at 1200 degrees C., to develop emission and to prepare them for the iridium coating.

Figure 7:
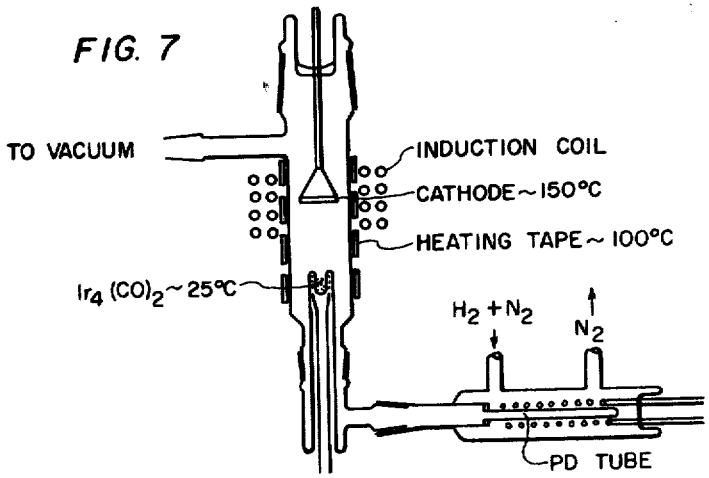
FIG. 7 is a diagram showing schematically the apparatus for iridium deposition.

The emission capabilities of the cathodes are measured prior to iridium coating. Iridium is then deposited on the cathodes by a chemical vapor deposition process (see FIG. 7). This process differs from evaporation or sputtering processes in that the chemical nature of the deposit differs from that of the vapor from which it was formed. In this instance iridium is obtained from the pyrolytic decomposition of iridium carbonyl. The purpose of the iridium film is to enhance the emission capability of the cathodes.

The details of the deposition of iridium are:

1. The cathode is heated inductively to about 150 degrees C. in the presence of hydrogen, at a pressure of 15 microns.

2. The iridium carbonyl is heated to about 110 degrees C. At this temperature it sublimes slowly. These vapors strike the cathode and decompose to form iridium metal and carbon monoxide gas.

3. The walls of the deposition apparatus are held at about 100 degrees C. to keep the carbonyl in the vapor state.

4. The thickness of the iridium deposit is determined by the length of time of deposition. Typically, a layer of 0.5 μm thickness is obtained in 1 hour. A check of the electron emission capability is optional at this point.

The next step in the process is to deposit the insulation on the surface of the iridium-coated cathodes. The insulation is a laminated structure, with each discrete layer of the structure serving a specific function. This step of the process is again a chemical vapor deposition; the apparatus is designed to allow both sides of the cathode to be coated uniformly. The reactant vapor stream is split into two parts and introduced axially at opposite ends of the apparatus. The vapors flow radially across the faces of the cathode and are extracted through slots in the side wall of the reaction chamber. The cathode is inductively heated to a temperature of 1050 degrees to 1075 degrees C. and held within this range during deposition. The total pressure during deposition is in the range of 2 to 5 mm.

The first layer deposited is BN, 0.5 μm thick; this layer acts as a stress reliever between the substrate and the subsequently deposited layers. The next layer is $Si_3N_4$ 0.4 to 0.6 μm thick, which acts as a difusion barrier, preventing cathode activators from diffusion into the insulating layer. Next, a layer of BN 10 to 15 μm thick is laid down to provide the required electrical insulation between the cathode and grid. The final layer is $Si_3N_4$ 0.2 to 0.3 μm thick; this serves to improve the adhesion between the metallic grid film and the insulating structure.

The details of the vapor phase chemical reactions involved are:

1. Diborane reacts with ammonia to give BN and other products. Since $B_2H_6$ and ammonia react on contact to form intermediates, they are mixed just before they enter the reaction chamber. The temperature at this point is high enough to maintain the intermediates and the undesirable byproducts in the vapor state so they can be pumped off.

2. Silicon nitride is obtained by reacting $SiH_4$ with ammonia. This reaction is more complex than that in 1, but is quite similar. The differences are in the intermediates and byproducts, but these are so maintained in the vapor phase and pumped off leaving only the desired product of the reaction, $Si_3N_4$.

3. Both diborane and $SiH_4$ are poisonous, explosive compounds. They are handled most conveniently as argon mixtures containing approximately 1.5 percent of the reactant gas, the remainder being argon. Ammonia is similarly obtained from an ammonia-argon mixture containing 10 percent ammonia.

4. The concentrations and flow rates are:

10% $NH_3$-90% Ar-110 atm-cm$^3$/min 1.5% $B_2H_6$-98.5% Ar-45 atm-cm$^3$/min 1.5% $SiH_4$-98.5% Ar-45 atm-cm$^3$/min 5. Principal reactions are:

$$B_2H_6 + 2NH_3 \rightarrow 2BN + 6H_2$$

$$3\,SiH_4 + 4NH_3 \rightarrow Si_3N_4 + 12H_2$$

The grid film coating step follows the insulation coating. The metallic grid film is also obtained by a chemical vapor deposition process. In this case molybdenum carbonyl is decomposed on the cathode surface. The temperature of the cathode is held at 1075 degrees C. A partial pressure of hydrogen is used to prevent carbide formation. The thickness of the film is about 5 m, obtained in a 45-minute coating cycle. The hydrogen pressure is about 20 microns; the $Mo(CO)_6+CO$ is also about 20 microns.

The grid and heater structures are photolithographed according to the following steps:

1. Application of photo-resist. The photo-resist material is spread over the surface of the cathode by means of a fresh, eye dropper type of dropping pipet. The cathode is then rotated at high speed (2000 to 8000 rmp). This spreads the photo-resist material into a thin, uniform layer.

2. A short baking cycle follows, during which the photo-resist layer is dried.

3. The process is then repeated on the opposite face of the cathode. This coat is also dried.

4. The grid and heater patterns are then formed by exposing the appropriate faces of the cathode through a mask to form the required patterns in the photo-resist.

5. Each unit is next put through a developing process which removes the unexposed photo-resist.

6. The final step in the photolithographic procedure is a bake which cures the photoresist and gives it the required toughness.

The grid detail is then developed in the following steps:

1. The metal film is removed from the grid openings using an acid chemical etch having the composition:

76 parts by volume $H_3PO_4$ (phospheric acid)
6 parts by volume $CH_3COOH$ (acetic acid)
3 parts by volume $HNO_3$ (nitric acid)
15 parts by volume $H_2O$ (water, distilled)

The etch time is 9 to 15 minutes. The heater side is etched at the same time to remove extraneous metal and leave the metal film heater pattern.

2. Nitride insulation is removed from the grid openings by an air abrasion method, using air-classified $Al_2O_3$ powder from which the fine and coarse fractions have been removed. A specially designed nozzle coupled to an automatic scanning device, with controlled air pressure, provides uniform abrasion over the entire exposed insulator surface of the cathode. The photoresist was previously developed to a toughness that will withstand the air abrasion until the insulation is substantially removed from the grid openings.

3. The cathode is subjected to ultrasonic cleaning in ethanol to remove $Al_2O_3$ particles which might be imbedded in the cathode surface.

4. The photo-resist is removed by heating the cathode to approximately 400 degrees C. in a low-pressure (10 microns) hydrogen atmosphere. At this temperature the photo-resist evaporates leaving no residue.

5. The cathode is again subjected to ultrasonic cleaning in ethanol to remove $Al_2O_3$ particles which had been imbedded in the photoresist and still remain.

6. Any insulation remaining in the grid openings or lodged in the pores of the cathode is removed by etching with ionized freon gas.

7. The final step is firing the unit in hydrogen to remove surface contaminants and aid in reactivation of the cathode. This step ensures complete removal of fluorides. The structure is now ready for mounting within the vacuum enclosure.

Note: The major reactions for the deposition of iridium and molybdenum from the pyrolytic decomposition of the carbonyl are:

$$Ir_2(CO)_8+\Delta_{heat}\rightarrow 2Ir+8CO$$

$$Mo(CO)_8+\Delta_{heat}\rightarrow Mo+6CO$$

$$Ir_4(CO)_{12}+\Delta_{heat}\rightarrow 4Ir+12CO$$

Reaction number 3 is not as likely as reaction 1 because $Ir_4(CO)_{12}$ is not as stable. Also, in the case of iridium, carbides are not formed; the hydrogen is used in this case to suppress the disproportionation of CO into $C+CO_2$. If such a reaction occurs, carbon is occluded in the iridium flim, giving it a brownish appearance and decreasing the cathode emission.

$$2CO\ C+CO_2;\ 4(a).\ 2CO+4H_2\ 2CH_3OH$$

Molybdenum forms two carbides: MoC and $Mo_2C$. These are reduced by the hydrogen to the metal.

$$MoC+2H_2\rightarrow Mo+CH_4$$

$$Mo_2C+2H_2\rightarrow 2Mo+CH_4$$

The vapors and gases are pumped off, leaving the metal film uncontaminated in each of the above cases.

What is claimed is:

1. A bonded grid-cathode structure comprising:
a tungsten cathode having an emission impregnant;
a grid of a refractory metal;
an insulator bonded to the cathode and to the grid, with openings through the grid and insulator to the cathode surface, wherein said insulator comprises a principal boron nitride (BN) layer and a relatively thin diffusion barrier of silicon nitride ($Si_3N_4$) bonded between the cathode and the BN layer to counteract the effects of diffusion of said impregnant into the insulator.

2. A bonded grid-cathode structure as claimed in claim 1, further including a relatively thin layer of silicon nitride bonded between the principal BN layer and the grid.

3. A bonded grid-cathode structure as claimed in claim 2, further including a relatively thin layer of BN bonded between the $Si_3N_4$ diffusion barrier and the cathode surface for stress relief, and wherein said cathode includes an iridium coating.

4. A unitary heater, cathode, and control grid structure for an electron discharge device which comprises a circular disk of porous refractory metal having two spaced parallel outer surfaces and a peripheral edge, an inorganic insulating layer which comprises a principal layer of BN covering the surfaces of said disk, and a film of refractory metal overlying substantially all of said insulating layer, the film on one surface having a grid-like configuration, the film on the other surface having a configuration of a heating coil, said disk containing thermionic emissive material, and the insulating layer on said one surface having openings extending into the porous disk corresponding to the openings in the grid-like configuration of said film, whereby when the film on the other surface is heated, electrons are directed through said openings in the insulating layer and the film on said one surface, the improvement comprising a relatively thin layer of $Si_3N_4$ as a diffusion barrier between said disk and said insulating layer.

5. The structure of claim 4, further including a relatively thin layer of $Si_3N_4$ between the principal layer of BN and said film of refractory metal.

6. The structure of claim 4, wherein said porous refractory metal of the disk is tungsten, the disk further having a coating of iridium directly on the porous tungsten at least on the surface with the gridlike configuration, a relatively thin layer of BN for stress relief between the iridium coating and the $Si_3N_4$ diffusion barrier.

7. The structure of claim 6, wherein said film of refractory metal is selected from the group comprising tungsten, tungsten carbide, molybdenum, molybdenum carbide and zirconium; and further including a relatively thin layer of $Si_3N_4$ between the principal layer of BN and the film of refractory metal.

8. The structure of claim 7, wherein said gridlike configuration comprises holes through the metal film and the insulating layer down to the iridium coating.

9. A bonded grid-cathode structure comprising:

a cathode, a grid of a refractory metal, an insulator principally of boron nitride bonded to the cathode and to the grid, with openings through the grid and insulator, in which said insulator comprises a thin layer of BN bonded to the cathode as a stress reliever, a thin layer of $Si_3N_4$ which acts as a diffusion barrier, a principal layer of BN, and a thin layer of $Si_3N_4$ which improves the adhesion between the metal grid and the insulating structure.

10. The method of forming a unitary heater, cathode, and control grid structure for an electron discharge device which comprises:

coating a disk of porous refractory metal with an inorganic insulating layer which includes a principal layer of BN, overcoating the insulating layer with a film of refractory metal, forming a grid pattern in the film on one side of the disk, forming openings in the film and insulating layer corresponding to the pattern, forming a heater on the other side of the disk, the disk being impregnant with thermionic emissive material, the improvement wherein said insulating layer is formed with a diffusion barrier of $Si_3N_4$ to counteract diffusion of said thermionic emissive material into the insulating layer.

11. The method of claim 10, further including a layer of $Si_3N_4$ formed between the BN layer and the film of refractory metal.

12. The method of claim 11, further including forming a relatively thin layer of BN between said disk and said diffusion barrier.

13. The method of making a bonded grid on a cathode, comprising the steps of:

(a) forming an insulator layer on said cathode, (b) forming a metal layer for the grid, on the insulating layer, (c) forming a photo-resist layer on the metal layer, (d) exposing the photo-resist layer with means to form a grid pattern, followed by a developing process which selectively moves part of the photo-resist layer to expose openings of said grid pattern, (e) removing the metal layer in said openings, (f) using air blasting with an abrasive powder to remove the insulator layer in said openings, with the photo-resist on the metal layer acting as a mask;

the improvement wherein step (a) comprises using chemical vapor deposition to:

deposit a thin layer of BN which acts as a stress reliever, deposit a thin layer of $Si_3N_4$ which acts as a diffusion barrier, deposit BN for the principal layer, deposit a thin layer of $Si_3N_4$ which serves to improve the adhesion between the metallic grid film and the insulating structure.

14. The method as claimed in claim 13, wherein said step (b) comprises forming said grid from the group of metals comprising W and Mo, using chemical vapor deposition from the metal carbonyl.

15. The method as claimed in claim 14, including the further step after step (f) of removing the remainder of the photo-resist by heating the cathode grid structure to approximately 400 degrees C. in a low pressure hydrogen atmosphere, whereby the photo-resist evaporates leaving no residue.

16. The method as claimed in claim 15, further including steps before and after the step of removing the photo-resist of subjecting the cathode to ultrasonic cleaning in ethanol to remove particles of the abrasive powder which might be imbedded in the cathode surface.

17. The method as claimed in claim 16, wherein said abrasive powder is $Al_2O_3$.

18. The method as claimed in claim 17, following the second ultrasonic cleaning in ethanol, further including the step of etching with ionized freon gas to remove any $Si_3N_4$ insulation remaining in the grid openings or lodged in the pores of the cathode.

19. The method as claimed in claim 18, further including a final step of firing the unit in hydrogen to remove surface contaminants and aid in reactivation of the cathode, and ensuring complete removal of fluorides.

* * * * *